US010465330B2

(12) United States Patent
Tiggesbaeumker

(10) Patent No.: US 10,465,330 B2
(45) Date of Patent: Nov. 5, 2019

(54) DOOR HANDLE FOR A DOOR OF A FRONT-LOADING HOUSEHOLD APPLIANCE

(71) Applicant: Miele & Cie. KG, Guetersloh (DE)

(72) Inventor: Silke Tiggesbaeumker, Guetersloh (DE)

(73) Assignee: MIELE & CIE. KG, Guetersloh (DE)

( * ) Notice: Subject to any disclaimer, the term of this patent is extended or adjusted under 35 U.S.C. 154(b) by 0 days.

(21) Appl. No.: 15/957,936

(22) Filed: Apr. 20, 2018

(65) Prior Publication Data

US 2018/0340289 A1 Nov. 29, 2018

(30) Foreign Application Priority Data

Apr. 24, 2017 (DE) ..... 10 2017 108 709

(51) Int. Cl.
*D06F 39/14* (2006.01)
*E05B 1/00* (2006.01)
*D06F 58/04* (2006.01)

(52) U.S. Cl.
CPC ..... *D06F 39/14* (2013.01); *E05B 1/0015* (2013.01); *E05B 1/0053* (2013.01); *D06F 58/04* (2013.01); *Y10T 16/458* (2015.01)

(58) Field of Classification Search
CPC ..... Y10T 16/458; D06F 39/14; D06F 37/28; D06F 58/04; E05B 1/0015; E05B 1/0053
USPC ..... 16/412; 68/196; 34/603
See application file for complete search history.

(56) References Cited

U.S. PATENT DOCUMENTS

| | | | | |
|---|---|---|---|---|
| 7,802,855 | B2 * | 9/2010 | Calmeise | D06F 39/14 312/228 |
| 8,151,603 | B2 * | 4/2012 | Kang | D06F 39/14 68/196 |
| 9,441,395 | B2 * | 9/2016 | Kim | D06F 39/14 |
| 2003/0172689 | A1 * | 9/2003 | Fitton | D06F 37/266 68/12.26 |
| 2004/0089031 | A1 | 5/2004 | Kim et al. | |
| 2005/0262887 | A1 * | 12/2005 | Kim | D06F 37/28 68/196 |
| 2006/0117809 | A1 * | 6/2006 | Ha | D06F 37/28 68/3 R |
| 2007/0075614 | A1 | 4/2007 | Calmeise | |
| 2010/0088917 | A1 | 4/2010 | Lim | |
| 2013/0002113 | A1 * | 1/2013 | Loss | D06F 37/28 312/291 |

(Continued)

FOREIGN PATENT DOCUMENTS

| | | | |
|---|---|---|---|
| CN | 1724777 | A | 1/2006 |
| DE | 102006029483 | A1 | 1/2008 |

(Continued)

*Primary Examiner* — William L Miller
(74) *Attorney, Agent, or Firm* — Leydig, Voit & Mayer, Ltd.

(57) ABSTRACT

A door handle for a door of a front-loading household appliance, such as a washing machine, a combination washer-dryer, or laundry dryer, which has a drum for laundry treatment and whose loading opening is closable at the front by a door hinged thereto as a ring, includes a gripping element as a handle provided in a lateral region of the ring for closing and opening purposes. The gripping element allows fingertips of a hand to grasp or be introduced into it from both radially outside and radially inside in the lateral region of the ring.

7 Claims, 1 Drawing Sheet

(56) References Cited

U.S. PATENT DOCUMENTS

| | | | | |
|---|---|---|---|---|
| 2013/0232810 | A1* | 9/2013 | Coxon | D06F 39/14 34/108 |
| 2015/0315740 | A1* | 11/2015 | Buso | D06F 39/14 312/329 |

FOREIGN PATENT DOCUMENTS

| | | | | |
|---|---|---|---|---|
| EP | 0255413 | A1 | 2/1988 | |
| EP | 1568816 | A2 * | 8/2005 | D06F 39/005 |
| EP | 2098627 | A1 | 9/2009 | |
| EP | 2098672 | A1 | 9/2009 | |
| EP | 2740832 | A1 * | 6/2014 | D06F 39/14 |
| GB | 2334872 | A | 9/1999 | |
| JP | 2015043800 | A * | 3/2015 | D06F 39/14 |
| JP | 2018057628 | A * | 4/2018 | |
| WO | WO-2014101965 | A1 * | 7/2014 | D06F 39/14 |

* cited by examiner

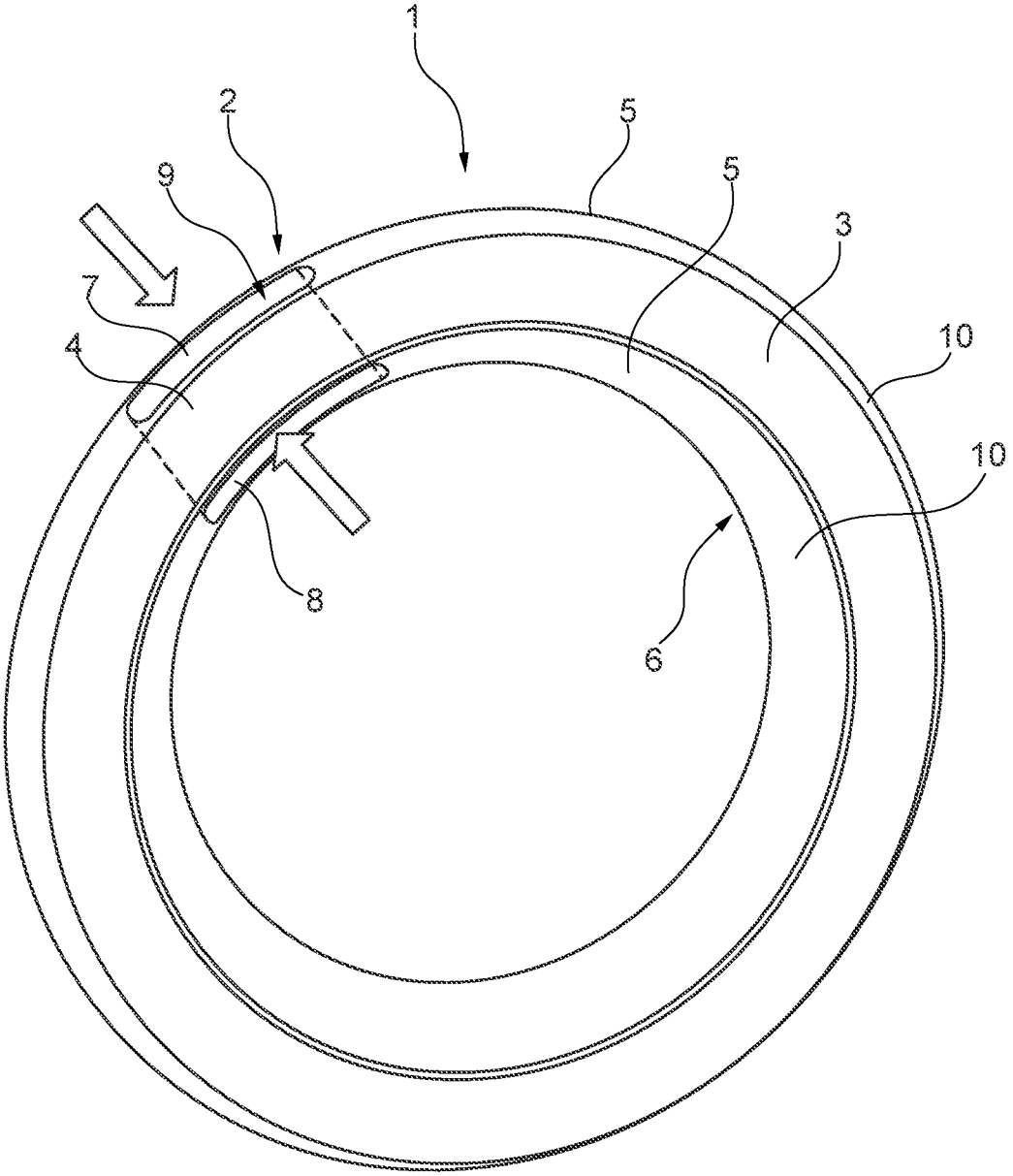
1
2
5
5
9
3
7
10
4
10
8
6

DOOR HANDLE FOR A DOOR OF A FRONT-LOADING HOUSEHOLD APPLIANCE

CROSS-REFERENCE TO PRIOR APPLICATION

Priority is claimed to German Patent Application No. DE 10 2017 108 709.5, filed on Apr. 24, 2017, the entire disclosure of which is incorporated by reference herein.

FIELD

The present invention relates to a door handle for a door of a front-loading household appliance, such as a washing machine, a combination washer-dryer or a laundry dryer, which has a drum for laundry treatment and whose loading opening is closable at the front by a door hinged thereto as a ring, a gripping element configured as a handle being provided in the lateral region of the ring for closing and opening purposes.

BACKGROUND

It is known from the prior art that, for example, household appliances which include a treatment chamber in the form of a drum in which laundry is treated in a program-controlled manner have a hinged door in the front of the appliance housing. The door includes a ring which has, for example, a door glass disposed therein, making it possible to look into the treatment chamber in the closed condition.

For door closure purposes, various options are available for locking the door at the front. The door can be unlocked by a controller in the region of the control panel, and the door can then be opened by hand, thereby providing clearance for accessing the drum through the loading opening. This allows the washing machine or laundry dryer to be unloaded or loaded, as the case may be.

European Patent Application EP 2 098 627 A1, for example, describes such a front-loading laundry appliance which is provided with a door of the type described where a door glass is disposed in a ring. In order to improve the ease of operation of the door i.e., here in the unlocked condition a gripping element configured as a handle is provided on the outer ring, and here in the lateral region of the ring. The gripping element itself is disposed such that it defines the grasping opening. In the prior art, the direction designated for grasping into the gripping element is mainly from radially outward to radially inward, so that the gripping element is disposed on the door ring such that it faces radially outward. It is also known to dispose the gripping element in a direction from radially inward to radially outward, so that the grasping opening is accessible from radially inside.

Thus, the disposition of the gripping element according to the prior art defines how the user has to insert the fingertips of the hand for grasping in order to open the door. This ultimately means that when the user has, for example, loaded the appliance, he or she must always grab into the radially inner region or into the radially outer region of the door in order to establish the closed position or the open position. Another option is when, for example, the door ring is pressed by hand onto the opening in some way, which, however, may lead to false latching of the locking element. Also, especially when opening the door ring, the predetermined grasping direction is then always from inward to outward or from outward to inward, which requires the user to stand in a particular position relative to the appliance housing. Such problems arise also for people who are left-handers or right-handers.

SUMMARY

In an embodiment, the present invention provides a door handle for a door of a front-loading household appliance, such as a washing machine, a combination washer-dryer, or laundry dryer, which has a drum for laundry treatment and whose loading opening is closable at the front by a door hinged thereto having a ring, the door handle comprising: a gripping element configured as a handle provided in a lateral region of the ring for closing and opening purposes, wherein the gripping element is configured to allow fingertips of a hand to grasp or be introduced into it from both radially outside and radially inside in the lateral region of the ring.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

The FIGURE is a perspective view of a door for a washing machine, a combination washer-dryer or a laundry dryer, the door being configured as a ring having a door glass.

DETAILED DESCRIPTION

The tunnel handle according to the present invention gives the user the freedom to choose between the options of grasping from radially outside or radially inside to open the door. This allows the user to decide himself or herself whether he or she can grasp into the door ring from radially outside or radially inside. This design provides the advantage that, during opening or closing of the door, the operation of grasping the door ring is no longer dependent on the position from which the user has to grasp because now, the user can grasp either from radially inside or radially outside. If the user stands to the right of the loading opening, he or she can now choose how he or she can better grasp into the tunnel handle as a right-hander or left-hander. The same applies also when the user stands to the left of the loading opening in order to open the door. Accordingly, the user can now choose the grasping position that works well for him or her, no matter whether he or she is a right-hander or a left-hander. The same applies also to the position that the user chooses in front of the washing machine or laundry dryer. Here, it is possible to position oneself in front of, to the right or to the left of the loading opening in order to then grasp with the hand in the most convenient manner, and to do so without having to change one's position.

The present invention suggests in accordance with its features that the gripping element allow the fingertips of a hand to grasp or be introduced into it from both radially outside and radially inside in the lateral region of the ring. This capability is advantageous in that it provides corresponding grasping options on the door ring independently of the position and also of whether the user is a right-hander or a left-hander, as described earlier, and in a manner that copes with any position and any gripping strength.

In an advantageous embodiment, the gripping element is incorporated in the ring of the door. To this end, the gripping element is disposed in the annular frame of the door. Specifically, the gripping element is configured in the shape of a tunnel in the annular frame.

In an advantageous refinement, the opposite openings of the tunnel form respective grasping openings or insertion openings for the fingertips. Specifically, the openings are disposed in the lateral region of the annular frame, which is trapezoidal in cross-section. In a refinement, the opening slots of the gripping element extend along the curved side faces of the annular frame. Thus, in particular, the openings blend here into the annular region in such a way that they do not have a disturbing effect on the shape of the ring and with respect to appearance.

The FIGURE shows, in isolated view, a door 1 for a front-loading household appliance, such as a washing machine, a combination washer-dryer or a laundry dryer, which has a drum for laundry treatment and whose loading opening is closable at the front by a door 1 hinged thereto as a ring 3. A gripping element 4 configured as a handle is provided in the lateral region of ring 3 as a door handle 2 for door 1 for closing and opening purposes.

As can be seen from the single figure, gripping element 4 allows the fingertips of a hand to grasp or be introduced into it from both radially outside and radially inside in lateral region 5 of ring 3 in the directions indicated by the arrows. As can be seen, gripping element 4 is incorporated in ring 3 of door 1. Gripping element 4 is disposed in annular frame 6 of door 1. Here, gripping element 4 is configured in the shape of a tunnel in annular frame 6, as is apparent from the opposite openings 7 and 8 of tunnel 9, which form respective grasping openings for insertion of the fingertips.

Specifically, openings 7 and 8 are disposed in lateral region 10 of annular frame 6, which is here trapezoidal in cross-section. Opening slots 7 and 8 of gripping element 4 extend along the curved side faces of annular frame 6. As is apparent from the illustration, it is possible to grasp, for example, with the right hand from below and, for example, with the left hand from above to thereby effect closing and opening of door 1 in an ergonomic manner.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

01 door
02 door handle
03 ring
04 gripping element
05 lateral region
06 annular frame
07 opening
08 opening
09 tunnel
10 lateral region

What is claimed is:

1. A door handle for a door of a front-loading household appliance comprising a washing machine, a combination washer-dryer, or laundry dryer, which has a drum for laundry treatment and whose loading opening is closable at the front by the door hinged thereto having a ring, the door handle comprising:

a gripping element configured as a handle provided in lateral regions of the ring for closing and opening purposes, wherein the gripping element is configured to allow fingertips of a hand to grasp and be introduced into it from both radially outside and radially inside in the respective lateral regions of the ring.

2. The door handle as recited in claim 1, wherein the gripping element is disposed in an annular frame of the door, which includes the ring.

3. The door handle as recited in claim 2, wherein the gripping element has a shape of a tunnel in the annular frame.

4. The door handle as recited in claim 3, wherein opposite openings of the tunnel comprise respective grasping openings or insertion openings for the fingertips.

5. The door handle as recited in claim 4, wherein the openings are disposed in lateral regions of the annular frame, which include the lateral regions of the ring.

6. The door handle as recited in claim 2, wherein the annular frame is trapezoidal in cross-section.

7. The door handle as recited in claim 4, wherein the opposite openings each comprise an opening slot that extends along one of the lateral regions of the annular frame, each lateral region of the annular frame comprising a curved side face.

* * * * *